US009580212B2

(12) United States Patent
Graux et al.

(10) Patent No.: US 9,580,212 B2
(45) Date of Patent: Feb. 28, 2017

(54) PACKAGING ASSEMBLY, INCLUDING A BOTTLE AND A GASKET-LESS CLOSURE FOR CLOSING THE NECK OF THE BOTTLE

(75) Inventors: Stéphane Graux, Liergues (FR); Richard Lamoureux, Rawdon (CA); Michel Luzzato, Ecully (FR)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 13/824,246

(22) PCT Filed: May 25, 2012

(86) PCT No.: PCT/EP2012/059830
§ 371 (c)(1),
(2), (4) Date: Apr. 29, 2013

(87) PCT Pub. No.: WO2012/163826
PCT Pub. Date: Dec. 6, 2012

(65) Prior Publication Data

US 2014/0076840 A1 Mar. 20, 2014

(30) Foreign Application Priority Data

May 27, 2011 (FR) ..... 11 54665

(51) Int. Cl.
*B65D 41/48* (2006.01)
*B65D 41/00* (2006.01)
(Continued)

(52) U.S. Cl.
CPC ..... *B65D 41/005* (2013.01); *B65D 41/465* (2013.01); *B65D 41/485* (2013.01); *B67D 3/0032* (2013.01)

(58) Field of Classification Search
CPC .... B65D 41/005; B65D 41/46; B65D 41/465; B65D 41/48; B65D 41/485; B67D 3/0032
(Continued)

(56) References Cited

U.S. PATENT DOCUMENTS 3,209,934 A * 10/1965 Salminen ..... 215/320
3,338,446 A * 8/1967 Faulstich ..... B65D 41/485 215/254

(Continued)

FOREIGN PATENT DOCUMENTS

AT 508589 A1 2/2011
CA 2577886 A1 8/2008

(Continued)

OTHER PUBLICATIONS

International Search Report of PCT/EP2012/059830, Sep. 3, 2012, 4 pages.

*Primary Examiner* — James N Smalley
(74) *Attorney, Agent, or Firm* — Finnegan, Henderson, Farabow, Garrett & Dunner, L.L.P.

(57) ABSTRACT

A packaging assembly includes a bottle, which may be used upside-down such that a neck is turned towards the ground, and a closure without any added seal gasket for closing the neck. This closure includes a cap for obturating the neck, and a skirt for attachment to the neck. The cap includes an inner sealing lip, delimiting on its outer face, a convex tight bearing surface for bearing tightly against the inner face of the neck, and a substantially flat ramp surface, which connects the tight bearing surface to a lower axial end of the lip, and which, while the lip is deformed with the remainder of the closure when an inner clip of the skirt interferes with an outer bead of the neck during placement of the closure on the neck, may interfere with a free end of the neck to guide engagement of the lip inside the neck.

9 Claims, 5 Drawing Sheets

(51) Int. Cl.
*B65D 41/46* (2006.01)
*B67D 3/00* (2006.01)

(58) Field of Classification Search
USPC .... 215/320, 343, 344, DIG. 1; 220/792, 795
See application file for complete search history.

(56) References Cited

U.S. PATENT DOCUMENTS

| | | | | | |
|---|---|---|---|---|---|
| 3,411,652 | A | * | 11/1968 | Shuffrey et al. | 215/320 |
| 3,468,447 | A | * | 9/1969 | Smalley | 215/295 |
| 3,494,496 | A | * | 2/1970 | Livingstone | 215/320 |
| 3,661,289 | A | * | 5/1972 | Segmuller | 215/256 |
| 3,899,097 | A | * | 8/1975 | Aichinger | 215/253 |
| 4,489,845 | A | * | 12/1984 | Aichinger B65D | 41/0421 215/329 |
| 5,762,218 | A | | 6/1998 | Sachau | |
| 5,957,316 | A | | 9/1999 | Hidding et al. | |
| 6,260,723 | B1 | * | 7/2001 | Bergholtz | 215/344 |
| 6,325,226 | B1 | * | 12/2001 | Krautkramer | 215/252 |
| 7,207,453 | B2 | * | 4/2007 | Rossi | 215/344 |
| 2010/0193464 | A1 | | 8/2010 | Perrin et al. | |

FOREIGN PATENT DOCUMENTS

| | | | |
|---|---|---|---|
| DE | 29912652 | U1 | 11/1999 |
| FR | 1479330 | A | 5/1967 |
| FR | 2839296 | A1 | 11/2003 |
| WO | WO 03/097475 | A1 | 11/2003 |

* cited by examiner

PACKAGING ASSEMBLY, INCLUDING A BOTTLE AND A GASKET-LESS CLOSURE FOR CLOSING THE NECK OF THE BOTTLE

CROSS-REFERENCE TO RELATED APPLICATIONS

This application is a U.S. National Phase of PCT/EP 2012/059830 filed on May 25, 2012, which claims the benefit of FR 1154665 filed on May 27, 2011, which is incorporated herein by reference.

TECHNICAL FIELD

The present invention relates to a packaging assembly, including a bottle and a closure without any added gasket for closing the neck of the bottle.

BACKGROUND

The invention thus concerns bottles of liquid, notably containing at least about 10 liters of liquid, often water, typically three, four or five gallon bottles, which are used in the upside-down position in drinking water dispensing fountains. Presently most of the bottles of this type are made in polycarbonate and may therefore be reused many times, while being cleaned before each filling. During the lifetime of such a bottle, the outer face of its neck gets damaged, which requires that an added flexible seal gasket, be provided in the bottom of the closure for closing the neck of the bottle, which avoids leaks by accommodating scratches and other surface irregularities of the neck. This packaging assembly however poses problems: polycarbonate is an expensive and relatively heavy material on the one hand and, the presence of an added gasket in the closure tends to give a spoiled odor and taste to the water contained in the bottle.

These problems are partly tackled by WO-A-2008/098362, which proposes a closure for closing a bottle without any added gasket. The seal is achieved by several outer sealing lips, which are applied on the outer face of the neck, including on the protruding bead with which this outer face is provided and around which an inner clip of the skirt of the closure is forcibly engaged, with flexible deformation of the closure until the clip is axially blocked against the bead of the neck.

For its part, WO-A-03/097475, on which is based the preamble of claim 1, discloses a closure interiorly provided with a sealing lip intended to cooperate with the inner face of the neck of a bottle. On paper, this solution seems appealing, but its practical application is thwarted: upon placement of the closure on the neck, an inner clip of the skirt of this closure interferes so much with an outer bead of the neck so as to in fine result in securing the contents of the bottle in the upside-down position, sufficiently strongly for withstanding, notably weight stresses, so that the closure undergoes overall deformation leading to bad positioning of the sealing lip relatively to the neck, or even to its squeezing between the free end surface of the neck and the remainder of the closure.

The bottle and the closure of DE-U-299 12 652 get round this problem by providing that the bead of the neck of the bottle is so far from the free end of this neck that, when this bead begins to interfere with the inner clip of the skirt of the closure, the free end of the neck is already facing radially a cylindrical running portion of a sealing lip with which the closure is interiorly provided: when the closure begins to deform under the effect of the interference between the aforementioned clip and bead, a large portion of this lip is therefore already accommodated inside the neck. This solution is of course not applicable to all the bottles.

BRIEF SUMMARY

The object of the present invention is to improve existing packagings, by proposing a both reliable and economic solution for ensuring the seal of the closure of the neck with a closure without any added gasket.

For this purpose, the object of the invention is a packaging assembly, as defined in claim 1.

One of the ideas at the basis of the invention is to try and seal the closing of the neck by the closure, from the inside of this neck. To do this, according to the invention, the closure includes a sealing lip with which the cap is provided, and which is conformed so as to substantially bear radially to the central axis of the neck, against the inner face of this neck, thereby forming between them a peripheral seal line. The invention further intends to take into account the specific context of the bottles of the type mentioned above, a context in which the closure has a large skirt diameter considering the outer diameter of the neck, with a value of several centimeters on the one hand, and the size of the bottle forces great interference between the inner clip of the skirt and the outer bead of the neck on the other hand, which causes the closure to undergo significant overall deformation when the clip is forcibly engaged around the bead, until it is axially blocked against the bead in order to secure the skirt around the neck; thus, according to the invention, the inner sealing lip has, in its terminal portion opposite to the cap, in other words in its terminal portion which will first interact with the neck upon putting the closure around the neck, a ramp surface, against which, during the aforementioned placement, the free end of the neck bears axially: by a ramp effect, the interference between this surface and the free end of the neck guides the engagement of the lip into the inside of the neck, by means of corresponding deformation of the lip, controlled by the sliding of the ramp surface against the free end of the neck. In other words, the interference between this ramp surface and the free end of the neck, upon putting the closure on the neck, advantageously allows improvement in the centering and introduction of the sealing lip into the inside of this neck. This arrangement of the invention is essential in the sense that, by default, because of the overall deformation undergone by the closure during the interference between the inner clip of its skirts and the outer bead of the neck, the inner sealing lip would be axially crushed between the free end surface of the neck and the cap of the closure.

By means of the inner sealing lip of the closure according to the invention, this closure may do without any added seal gasket, while guaranteeing reliable sealed closing of the neck. Moreover, the performances of this inner sealing lip are such that the invention finds a preferential application to a packaging assembly, the bottle of which containing at least about ten liters of liquid, and is made in polyethylene terephthalate (PET). Further, the presence of this inner sealing lip is economical, in the sense that the closure according to the invention remains easy to make, notably by molding of plastic material.

Advantageous additional features of the packaging assembly according to the invention, taken individually or according to all technically possible combinations, are specified in the claims.

BRIEF DESCRIPTION OF THE DRAWINGS

The invention will be better understood upon reading the following description, only given as an example and made with reference to the drawings, wherein.

DETAILED DESCRIPTION

Figure 1:
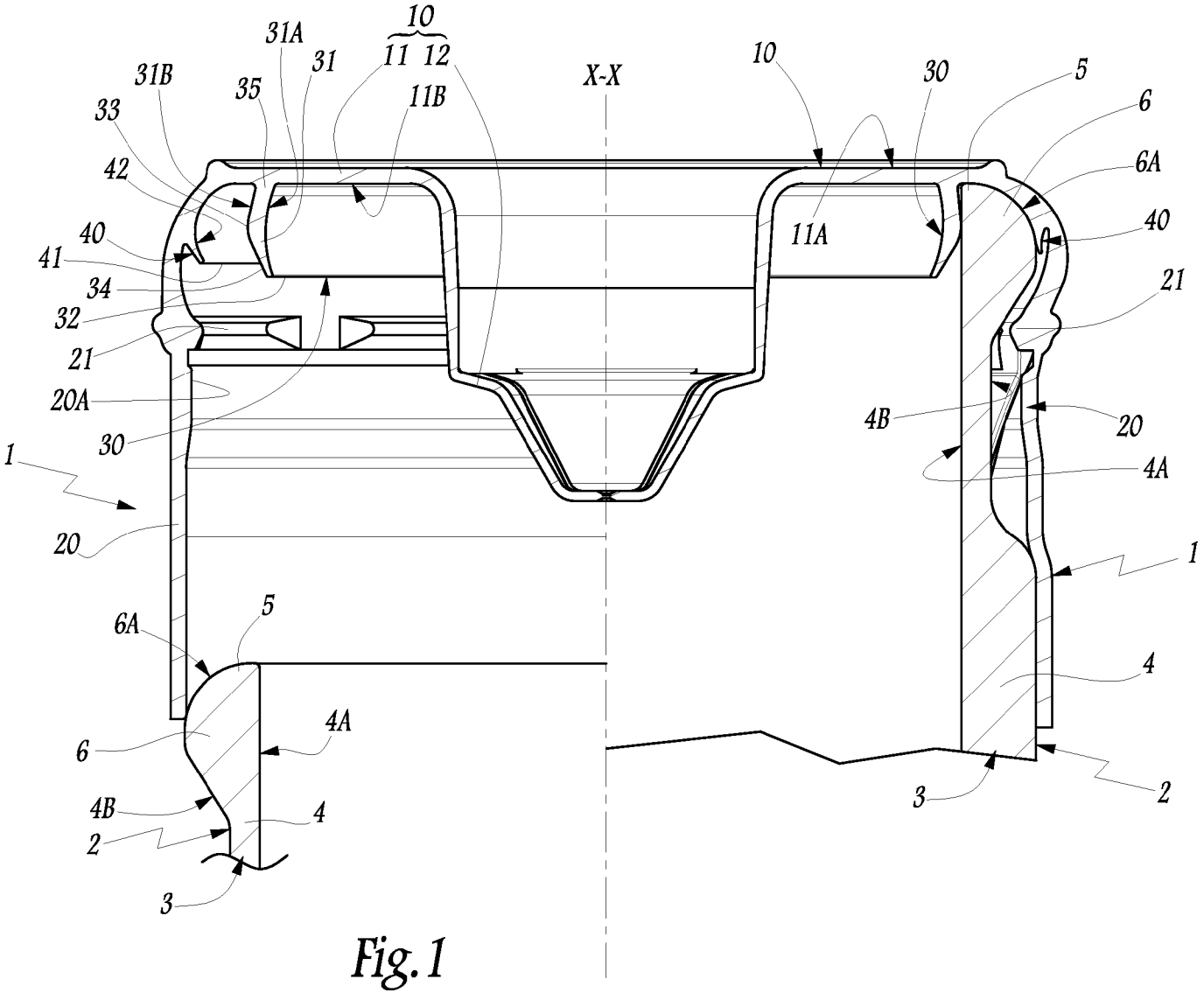
FIG. 1 is a longitudinal sectional view of a packaging assembly according to the invention, the left half of this figure showing the closure and the bottle of this assembly when this closure has not been yet placed on the neck of the bottle in order to close it, while the right portion of this figure shows the closure placed on the neck, in a closing configuration of this neck.

A closure 1 capable of closing the neck 3 of a bottle 2 is illustrated in FIGS. 1 to 5.

Generally, the neck 3 is either made in the same material with the remainder of the bottle 2, notably when the latter is in glass or in plastic, or adapted so as to be permanently firmly attached onto a wall of the bottle 2, at an aperture crossing this wall. As discussed in the introductory portion of the present document, the bottle 2 preferentially contains at least about 10 liters of liquid, notably water. This bottle thus has for example a capacity of three, four or five gallons. In this context, this bottle, notably its neck 3, is advantageously made in polyethylene terephthalate (PET), which gives the bottle, some lightness while allowing its reuse several times.

The neck 3 has a globally tubular shape, the central longitudinal axis is referenced as X-X. Conveniently, the following of the description of the closure 1 is oriented relatively to the axis X-X, by considering that the terms of <<lower>> et <<bottom>> describe a portion of the closure, which is directed axially towards the main body of the bottle 2 when the closure 1 obturates the neck 3 of this bottle and while the latter rests on a horizontal plane, such as a table, with its neck 3 directed upwards, like in the figures. Conversely, the terms of <<upper>> and <<top>> correspond to an axial direction in the opposite sense. Also, the term of <<inner>> describes a portion of the closure 1, which is directed transversely towards the axis X-X, while the term of <<outer>> corresponds to a transverse direction in the opposite sense.

The neck 3 includes a globally tubular body 4, with a circular base and centered on the axis X-X. The top axial end 5 of the body 4 is free, while opening outwards, while, at its opposite axial end, the body 4 opens into the main body of the bottle 2. The free end 5 of the body 4 connects the inner 4A and outer 4B faces of this body, with each other. The outer face 4A is substantially cylindrical, centered on the axis X-X, and with a circular base. The outer face 4B of the body 4 is provided with a bead 6 protruding outwards, the convex surface 6A of which connects a running axial portion of the body 4 to the free end 5 of the latter.

As this is clearly apparent in FIG. 1, the closure 1 has a globally tubular shape, the central longitudinal axis of which coincides with the axis X-X of the neck 3 when the closure 1 is placed on the neck. The closure 1 is open at its lower end and closed at its upper end by a cap 10 which, when the closure 1 is in a closing configuration on the neck 3, like in the right portion of FIG. 1, is laid out through the inner aperture of the neck so as to obturate the latter. The outer peripheral portion 11 of the cap 10 is globally planar, the upper face 11A of this outer peripheral portion 11 being generally used for supporting an added label, not shown in the figures, or a similar element, typically adhesively bound against this face 11A. The inner peripheral portion 12 of the cap 10, as for it, has a staged tubular shape, centered on the axis X-X, which is typically intended for cooperating with a supply head of a drinking water fountain and which will not be further described herein, insofar that this aspect of the closure 1 is not a limitation of the invention.

At the outer periphery of the cap 10, a globally tubular skirt 20 extends downwards, centered on the axis X-X, and with a circular base, having been made in the same material, with the peripheral portion 11 of the cap. The running portion of the inner face 20A of the skirt 20 is provided with a clip 21 protruding inwards, this clip being intended to cooperate by diametrical interference with the outer bead 6 of the neck 3 with the purpose of attaching the skirt 20 coaxially around the neck 3 when the closure 1 is in the closing configuration on this neck, as explained in more detail subsequently. In the embodiment, considered in the figures, the clip 21 runs over the inner periphery of the skirt 20 while being regularly interrupted, which amounts to stating that this clip 21 consists of a succession of a bulging portions, distributed along the periphery of the inner face 20A of the skirt 20. In a way known per se, this layout aims at increasing the transverse flexibility of the skirt 20 at the axial level of the clip 21. Of course, as an alternative, not shown, this clip may be provided so as to be continuous over the whole inner periphery of the skirt.

The closure 1 also includes a sealing lip 30, which has a globally ring-shaped form, with a circular base and centered on the axis X-X, which extends downwards from the cap 10, while having been made in the same material with the lower face 11B of the outer peripheral portion 11 of this cap 10. The lip 30 runs over the whole lower periphery of the portion 11 of the cap 10. This lip 30 is laid out coaxially inside the skirt 20, with radial interposition between them of a free space which, when the closure 1 is in a closing configuration on the neck 3, is occupied by the free end 5 of the body 4 of the latter.

In the embodiment of FIGS. 1 to 5, the lip 30 consists in a single ring-shaped wall 31, which extends protruding downwards from the lower face 11B of the portion 11 of the cap 10, with a thickness, in other words, a radial dimension between the inner 31A and outer 31B faces of this wall 31, substantially decreasing as far as the lower free end 32 of this wall 31.

The outer face 31B of the lip 30 in its running portion has a convex surface 33, which is intended for tight bearing against the inner face 4A of the body 4 of the neck 3, and which is connected to the lower free end 32 of the wall 31 by a substantially flat surface 34.

Advantageously, the closure 1 also includes a sealing lip 40, which extends protrusively inwards from the lower face 20A of the skirt 20, while being axially located between the clip 21 and the upper end of the skirt 20, bound to the outer periphery of the cap 10. The lip 40 runs over the whole inner periphery of the skirt 20. For reasons which will appear later on, the lip 40 is substantially located radially facing the convex surface 33 of the lip 30. Also, for reasons which will become apparent later on, it will be noted that, as this is clearly apparent in the left portion of FIG. 1, the free end 41 of the lip 40 is connected to the lower face 11B of the outer peripheral portion 11 of the cap 10, by a continuously curved surface 42, i.e. without any protruding discontinuities relatively to the remainder of this surface 42.

Other features of the closure 1, in particular of its cap 10, of its skirt 20 and of its lips 30 and 40, will be explained hereafter. Considering the successive steps for placing the closure 1 on the neck 3 of the bottle 2, with view to closing this neck.

Initially, the closure 1 has the rest configuration illustrated by the left half of FIG. 1. In practice, this rest configuration corresponds to a configuration for exiting the mold, the closure 1 being preferentially made in one single piece in plastic material, notably in polyethylene or polypropylene.

It will be noted that, in this rest configuration of the closure 1, the latter has dimensions adapted to the neck 3 of the bottle 2. In particular, the maximum outer diameter of the lip 30, which corresponds to the maximum diameter of the convex surface 33 of its outer face 31B, is strictly greater than the diameter of the inner face 4A of the body 4 of the neck 3. Further, the minimum inner diameter of the clip 21 of the skirt 20 is strictly smaller than the maximum outer diameter of the bead 6 of the neck 3.

When the closure 1 is in its rest configuration, it is axially engaged around the neck 3, the free end 5 of this neck being introduced into the open lower end of the skirt 20 and gradually moved closer axially to the cap 10. Of course, the engagement movement between the closure 1 and the neck 3 is relative, so that, in practice, either one or both of them are caused to move for the purpose of this engagement.

Figure 3:
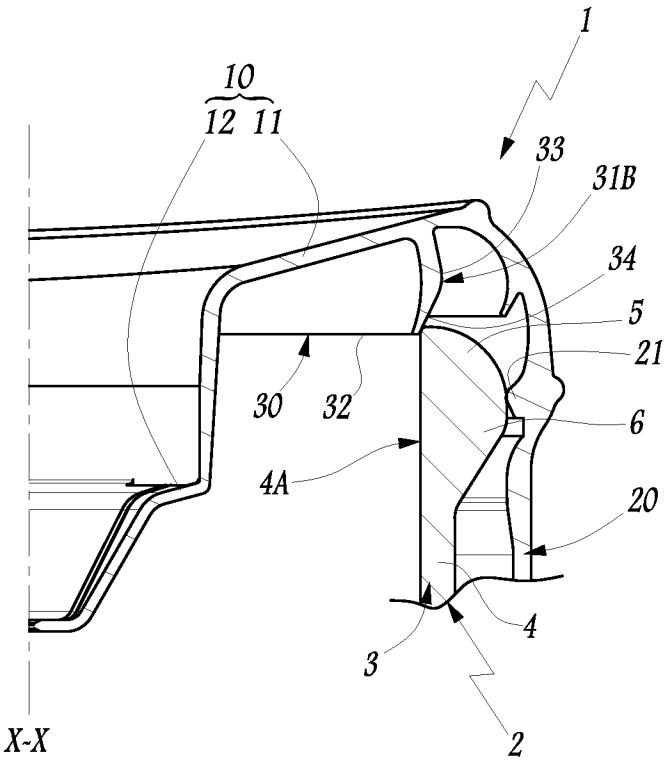
FIGS. 2 to 5 are axial half-sectional views of the packaging assembly of FIG. 1, which respectively show successive configurations of the closure upon its placement on the neck, from its configuration of the left half of FIG. 1 to its configuration of the right half of FIG. 1.
Figure 2:
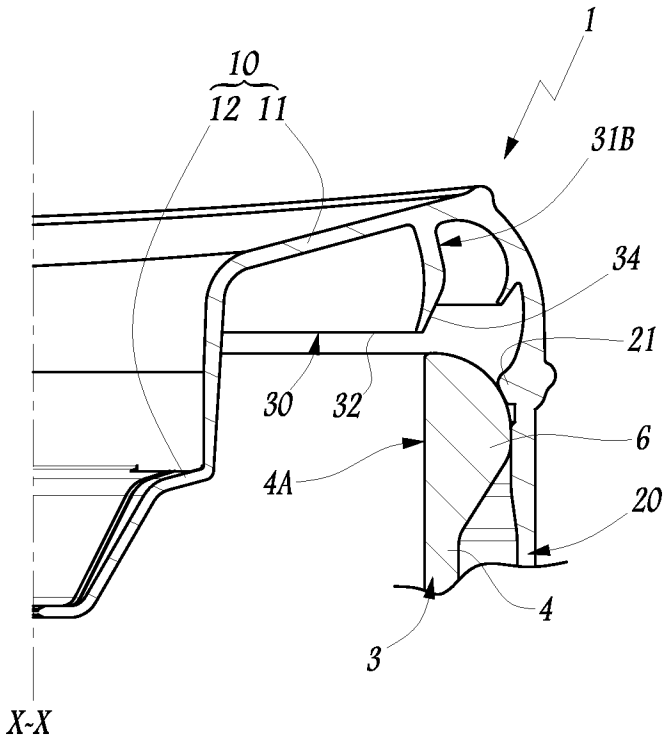

It is understood that, during the engagement towards the top of the neck 3 inside the skirt 20, the clip 21 of the skirt will diametrically interfere with the bead 6 of the neck 3, as illustrated at gradually in FIGS. 2 to 5. More specifically, as illustrated in FIG. 2, the lower portion of the clip 21 is first bearing downwards against the upper portion of the bead 6, which then forces the skirt 22 deform flexibly, radially outwards. The difference between the minimum inner diameter of the clip 21 and the maximum outer diameter of the bead 6 is provided to be so large, for reasons related to the requirement of achieving sufficiently firm attachment of the skirt 20 around the neck 3 in order to withstand stresses, notably weight stresses, from the contents of the bottle 2 in the upside-down position of this bottle, so that the deformation of the skirt 20 is transmitted to the remainder of the closure 1, in particular, at the outer peripheral portion 11 of the cap 10, and consequently to the lip 30: as this is clearly apparent by comparing FIGS. 1, 2 and 3, the lip 30 is then deformed together with the remainder of the closure 1, the lower end 32 of the lip being thus shifted radially outwards relatively to the position which it occupied when the closure 1 was in its rest configuration. Because of the design of the lip 30, this outward shift of its lower end 32 is provided in order to however maintain this lower end 32 radially inside the free end 5 of the body 4 of the neck 3 when this free end 5 interferes by contact with the lip 30: more specifically, this amounts to stating that, when, upon placement of the closure 1 on the neck 3, the free end 5 of this neck is located at the same axial level as the lower end 32 of the lip 30, the outer diameter of this lower end 32 has a value less than the diameter of the inner face 4A of the neck 3, as this is clearly apparent in FIG. 3. Of course, considering the overall deformation of the closure 1, it is understood that the value of the outer diameter of the lower end 32 of the lip 30 changes during the diametrical interference between the clip 21 and the bead 6, this time-dependent change consisting, in a first phase, in an increase of this value of the outer diameter of the end 32, as this is clearly apparent by comparing FIGS. 1, 2 and 3, until the free end of 5 of the neck 3 interferes by contact with the outer face 31B of the lip 30, as illustrated in FIG. 3. Next, as this is clearly apparent by comparing FIGS. 3 and 4, the progression of the engagement towards the top of the neck 3 inside the skirt 20 leads to a decrease in the value of the outer diameter of the end 32 of the lip 30: this is due to a ramp effect produced by the surface 34 of the outer face 31B of the lip 30, against which the free end 5 of the neck 3 bears upwards. In other words, considering the substantially flat conformation of the surface 34, having the latter interfere with the free end 5 of the body 4 causes flexible deformation of the lip 30, somewhat opposed to the deformation which this lip 30 has undergone up to then with the remainder of the closure 1 because of the interference between the clip 21 and the bead 6, by the sliding of the free end 5 of the neck 3 against the surface 34, from its lower end 32, or a region close to this lower end, as far as the convex surface 33, as this is clearly apparent by comparing FIGS. 3, 4 and 5.

By taking into account the foregoing explanations, it is understood that the ramp effect described above is advantageously reinforced by providing that the surface 34 has a substantially frusto-conical conformation centered on the X-X axis and convergent towards this axis in the opposite direction to the cap 10, when the free end 5 of the neck 3 interferes with this surface 34. In practice, as this is clearly apparent by comparing FIGS. 1 and 3, this frusto-conical conformation of the surface 34 is also found again when the closure 1 is in its rest configuration and in the intermediate configurations between the latter and that of FIG. 3, with the difference that the half angle at the apex of this frusto-conical conformation when the closure 1 is in its rest configuration, has a greater value than the one which it has when the free end 5 of the neck 3 is found located at the same axial level as the lower end 32 of the lip 30, like in FIG. 3

Figure 5:
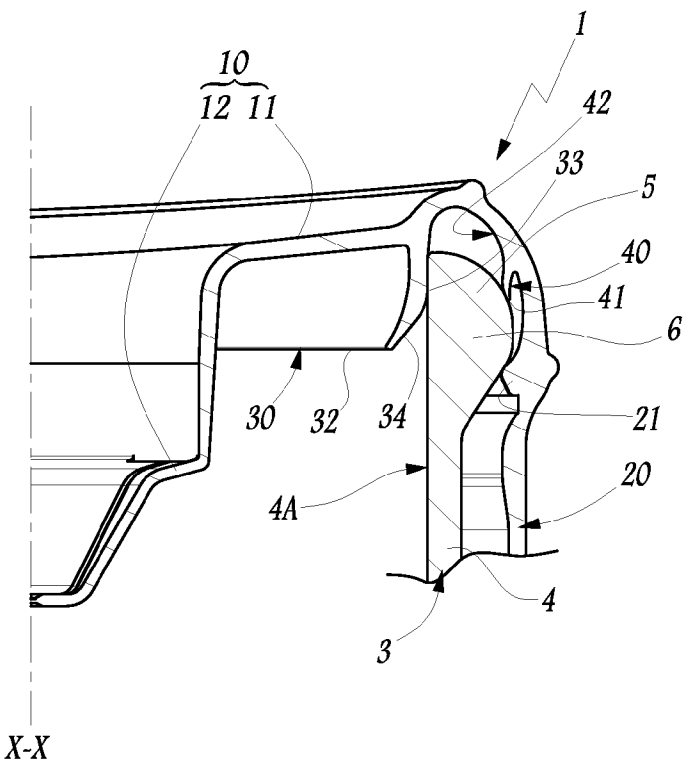
Figure 4:
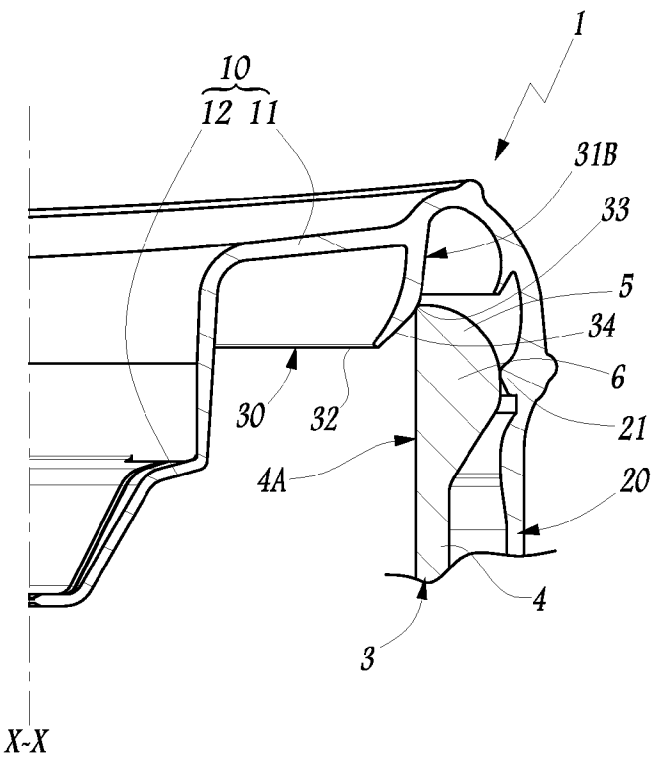

By continuing the engagement towards the top of the neck 3 inside the skirt 20, the inner face 4A of this neck, is again found, after guiding its free end 5 along the ramp surface 34, radially bearing against the convex surface 33, as shown in FIG. 5. Insofar that the lip 40 is substantially laid out radially facing this convex surface 33, it is understood that this lip 40 then begins to interfere by contact with the outer face 4B of the neck 3, more specifically with its bead 6, once the top portion of the latter is found axially above the clip 21, while being radially interposed between the lips 30 and 40. In this configuration of FIG. 5, the clip 21 is found under the bead 6, by being axially blocked against the low portion of this bead: this amounts to stating that the bulge 21 has crossed downwards the maximum outer diameter of the bead 6, then allowing the closure 1 to come back to a configuration close to its rest configuration, by elastic return, while, of course, taking into account the presence of the neck 3.

By further continuing the engagement towards the top of the neck 3 inside the skirt 20 until the closing configuration of the closure 1, illustrated in the right half of FIG. 1, is attained, the lip 40 is radially stressed outwards by the top portion of the bead 6, by being essentially folded back against the portion of the inner face 20A of the skirt 20, connecting this lip 42 to the clip 21. By doing this, the essential part of the lip 40 is withdrawn outwards in order to allow the curved surface 42 to encase in a substantially adjusted way, the top portion of the bead 6 of the neck 3, notably an outer peripheral portion of its surface 6A. In this way, the lip 40 is sealably pressed against the bead 6 of the neck 3, with a significant transverse pressure and over a large contact extent, via the surface 42. In other words, this surface 42 provides an outer seal on the neck 3, the performances of which are such that the closing of the neck 3 by the closure 1 remains hermetic even in the case of a leak of liquid between the lip 30 and the inner face 4A of the neck 3, notably when this inner face has scratches or irregularities not completely sealed by the convex surface 33 of the lip 30.

Advantageously, in the closing configuration which the closure 1 finally attains, illustrated in the right portion of FIG. 1, it is noted that a free space radially subsists between the inner face 4A of the neck 3 and the upper end 35 of the wall 31 of the lip 30. In other words, the lip 30 is designed so that, in the closing configuration of the closure 1, its axial end 35, forming the link between the remainder of the lip and the lower face 11B of the outer peripheral portion 11 of the cap 10, has an outer diameter, the value of which is less than or equal to, preferably strictly less than, the diameter of the inner face of the neck 3. In this way, the outer face 31B radially bears against the inner face 4A of the neck 3 with a force directed outwards, related to the resilience of the lip 30, which by elastic return tends to again find its position upon exiting the mold, opposite to the cap 10.

Figure 6:
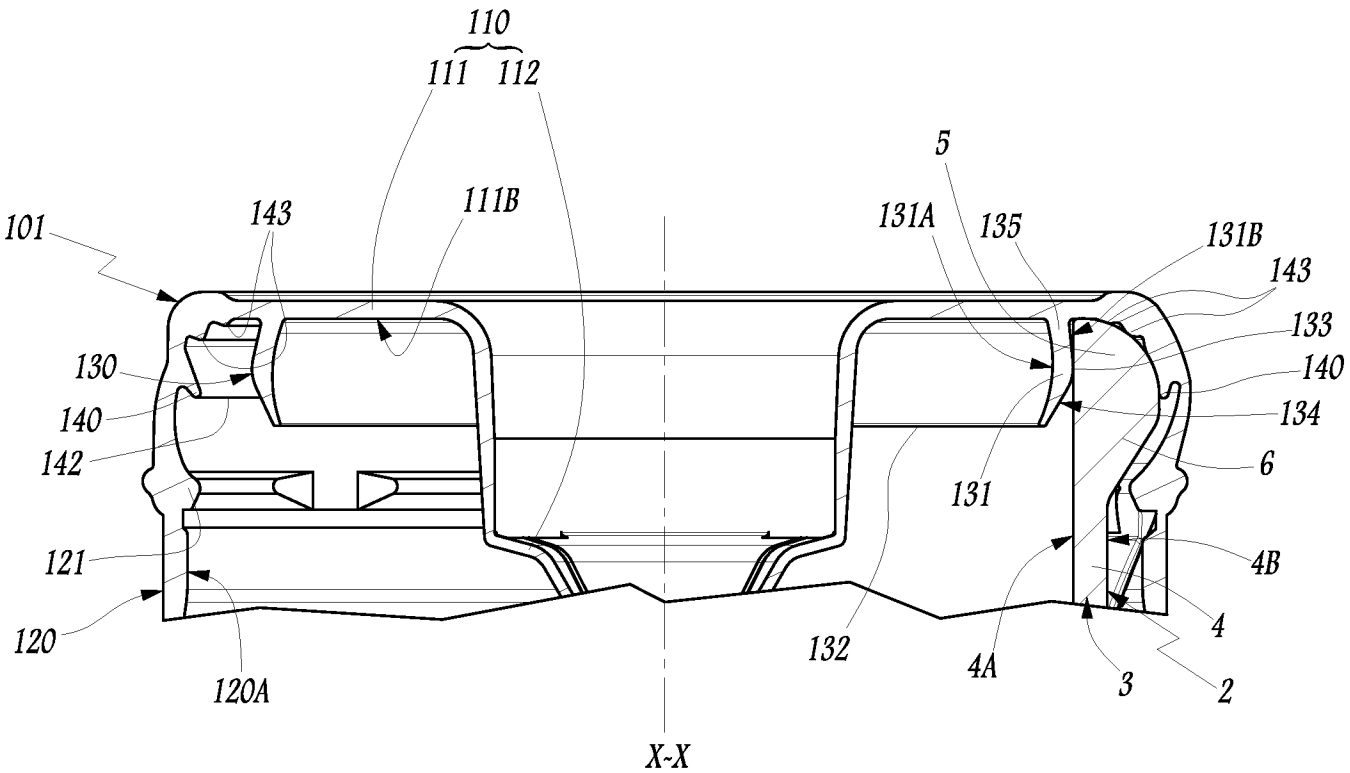
FIGS. 6 and 7 are views similar to FIG. 1, respectively showing two alternative packaging assemblies according to the invention.

In FIG. 6 an alternative embodiment is illustrated of the closure 1, which is referenced as 101. This closure 101 includes a cap 110, a skirt 120 and a sealing lip which are structurally and functionally similar to the cap 10, to the skirt 20 and to the lip 30 of the closure 1 respectively. This is why in FIG. 6, the elements relating to these three components 110, 120 and 130 of the closure 101 bear the same references as the corresponding elements of the components 10, 20 and 30 of the closure 1, increased by a hundred.

The closure 101 is distinguished from the closure 1 by arrangements aiming at sealing the outside of the neck 3. More specifically, the closure 101 includes an outer sealing lip 140, which, like the lip 40 of the closure 1, extends protruding from the inner face 120A of the skirt 120, while being axially located between the clip 121 and the cap 110 on the one hand and radially facing the sealed supporting surface 133 of the inner sealing lip 130. However, unlike the lip 40 of the closure 1, the lip 140 does not have in connection with the cap, a continuously curved sealed surface, similar to the surface 42 described above. On the contrary, in the connecting area between the lip 140 and the lower face 111B of the outer peripheral portion 111 of the cap 110, two protruding teeth 143 are provided, positioned in order to form respective contact points with the upper portion of the convex surface 6A of the bead 6. The shape of the lip 140 and the presence of the teeth 143 are in fact compliant with the technical teaching of WO-A-2008/098362 to which the reader may refer for more detail. It will be noted that the aforementioned technical teaching is of particular new interest within the closure 101, because of its association with the inner sealing lip 130.

Figure 7:
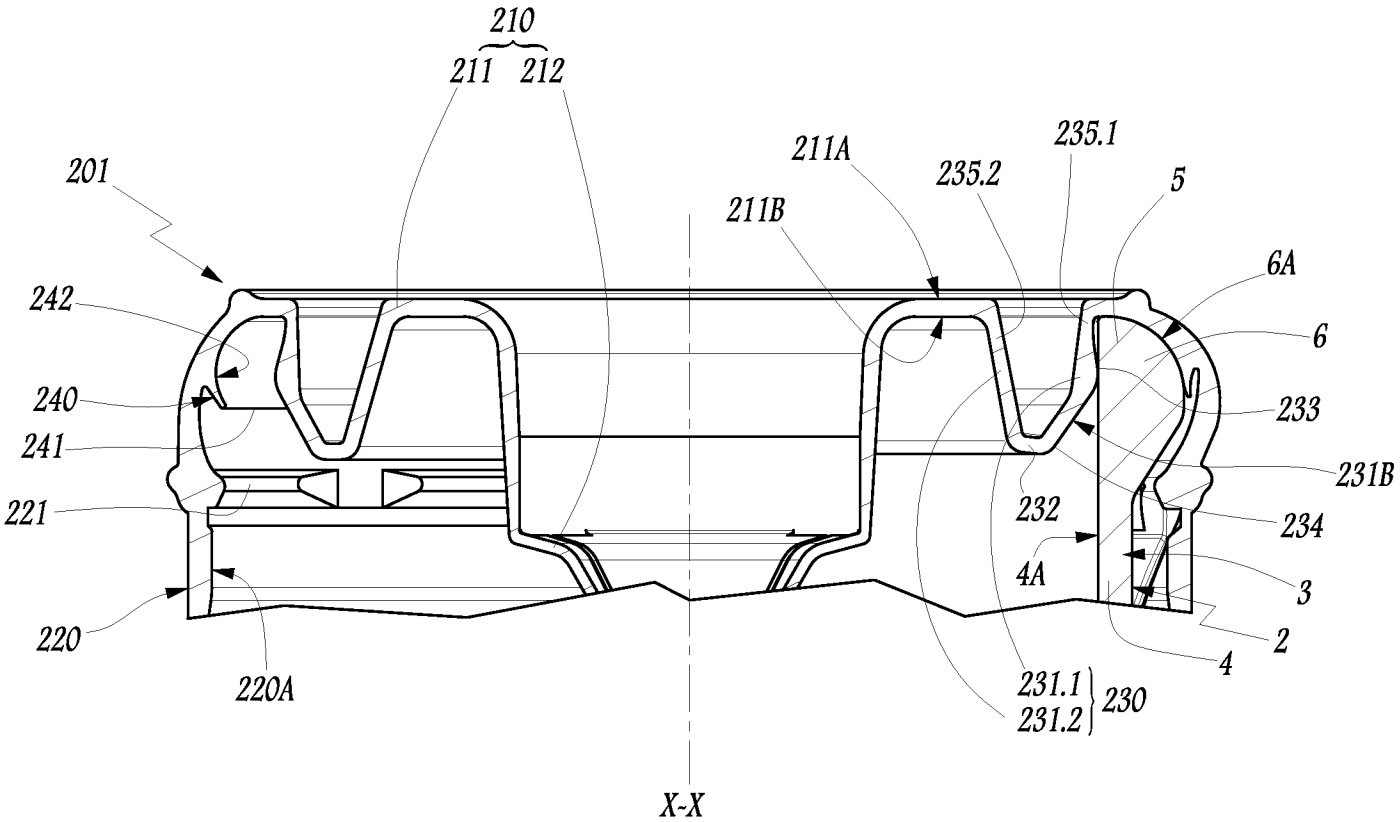

In FIG. 7 another alternative embodiment is illustrated, of the closure 1, referenced as 201. The closure 201 includes a cap 210, a skirt 220 and an outer sealing lip 240, which are structurally and functionally similar, to the cap 10, to the skirt 20 and to the lip 40 of the closure 1, respectively. This is why in FIG. 7, the elements relating to the components 210, 220 and 240 bear the same references as the corresponding elements of the components 10, 20 and 40 of the closure 1, increased by two hundred.

The closure 201 is distinguished from the closure 1 by the embodiment of its inner sealing lip 230. Indeed, as this is clearly apparent in FIG. 7, this lip 230 does not consist in a single ring-shaped wall, like the wall 31 for the lip 30, but of two coaxial ring-shaped walls, i.e. an outer wall 231.1 and an inner wall 231.2. Both of these ring-shaped walls extend protruding from the lower face 211B of the peripheral portion 211 of the cap 210, in a distinct way from each other at their respective upper ends 235.1, 235.2. On the other hand, opposite to their upper ends 235.1, 235.2, these walls 231.1 and 231.2 join up while forming a lower end 232 in one single piece. Of course, this is the outer wall 231.1, which delimits, on its outer face 231B, both a convex surface 233, which is structurally and functionally similar to the surface 33 of the outer face 31B of the lip 30, and a ramp surface 234 connecting the surface 233 to the lower end 232, a surface 234, which is functionally and structurally similar to the surface 34 of the lip 30.

Producing the lip 230 with both ring-shaped walls 231.1 and 231.2 facilitates the making of this lip, notably its removal from the mold, and gives greater flexibility to the lip, comparatively with the production of the lip 30 with the single ring-shaped wall 31. However, considering the lack of material between these walls 231.1 and 231.2, in particular, radially between their upper end 235.1 and 235.2, the upper face 211A of the outer peripheral portion 211 of the cap 210 has a more limited radial extent so as to adhesively bond an added label or more generally, so as to firmly attach a similar added element thereto.

Various arrangements and alternatives of the bottle 2 and of the closures 1, 101 and 201 described up to now may moreover be contemplated.

The invention claimed is:

1. A packaging assembly, including a bottle, which comprises a tubular neck centered on an axis and a protruding portion at a distal end of the neck, and a closure for closing the neck, said closure comprising:

a cap that, when the closure is in a closing configuration on the neck, covers an inner aperture of the neck, and having an inner sealing lip that is ring shaped, and that is substantially coaxial with an inside of the neck when the closure is in the closing configuration on the neck, and a skirt for securing the cap to the neck, wherein said skirt is tubular, and wherein said skirt extends axially from the cap and is substantially coaxial with the neck when the closure is in the closing configuration on the neck, and wherein the skirt is provided with a clip, which extends by protruding from an inner face of the skirt and which, by flexible deformation of the closure, is configured to interfere with the protruding portion of the neck as the closure moves axially with respect to the neck when securing the closure to the neck, until the clip secures the skirt to the neck, wherein an outer surface of the inner sealing lip delimits both:

a convex bearing surface for bearing against an inner face of the neck, and a ramp surface having a substantially flat surface and which connects the bearing surface to an axial end of the inner sealing lip, and which, while the inner sealing lip is deformed when the clip of the skirt interferes with the protruding portion of the neck, is configured to interfere with the end of the neck in order to guide engagement of the inner sealing lip into the inside of the neck, wherein the axial end of the inner sealing lip is axially closer to the end of the neck than the clip when the closure is in the closing configuration, wherein the skirt is provided with an outer sealing lip, which extends protruding from the inner face of the skirt downward and away from the cap, and which is located axially between the clip of the skirt and the cap, and, radially faces the bearing surface of the inner sealing lip, and wherein the outer sealing lip is integral with the face of the cap turned towards the neck by a curved sealed surface capable of encasing the protruding portion of the neck.

2. The packaging assembly according to claim 1, wherein the axial end of the inner sealing lip has an outer diameter, the value of which changes with time during the flexible deformation of the closure when the clip of the skirt interferes with the protruding portion of the neck, the value being less than the diameter of the interior face of the neck when, during the placement of the closure on the neck, the free end of the neck is located at substantially the same axial level as said axial end of the inner sealing lip.

3. The packaging assembly according to claim 1, wherein at least when, during the placement of the closure on the neck, the free end of the neck is located at substantially the same axial level as the axial end of the inner sealing lip, the ramp surface is substantially frusta-conical centered on the axis, while being convergent towards the axis in a direction opposite to the cap.

4. The packaging assembly according to claim 1, wherein the axial end of the inner sealing lip has an outer diameter which, when the closure is in a closing configuration on the neck, has a value which is less than or equal to the diameter of the inner face of the neck.

5. The packaging assembly according to claim 1, wherein the inner sealing lip includes a single ring-shaped wall, which delimits on its outer face, the bearing surface and the ramp surface, and which extends protruding from the face of the cap, turned towards the neck when the closure is in a closing configuration on the neck, with a substantially decreasing thickness as far as the axial end of the inner sealing lip.

6. The packaging assembly according to claim 1, wherein the inner sealing lip includes two coaxial ring-shaped walls, including a wall located radially outside of the other wall, which delimits on its outer face, the bearing surface and the ramp surface, and which extend protruding from the face of the cap, turned towards the neck when the closure is in a closing configuration on the neck, while being distinct from each other at their axial end turned towards the cap, while, at the opposite of the cap, the ring shaped walls join together and form an opposite axial end in one single piece.

7. The packaging assembly according to claim 1, wherein the bottle contains at least about ten liters of liquid.

8. The packaging assembly according to claim 1, wherein the bottle is in polyethylene terephthalate.

9. The packaging assembly according to claim 1, wherein the continuously curved sealed surface is configured to encase an outer peripheral portion of a convex surface of the protruding portion of the neck.

* * * * *